United States Patent [19]

Allison

[11] Patent Number: 4,890,742

[45] **Date of Patent: * Jan. 2, 1990**

[54] CHILD-RESISTANT MOISTURE-PROOF CONTAINER

[75] Inventor: Blaine M. Allison, Pemberville, Ohio

[73] Assignee: Lumelite Corporation, Pawling, N.Y.

[ * ] Notice: The portion of the term of this patent subsequent to Mar. 15, 2005 has been disclaimed.

[21] Appl. No.: 155,871

[22] Filed: Feb. 16, 1988

Related U.S. Application Data

[63] Continuation-in-part of Ser. No. 926,556, Nov. 4, 1986, Pat. No. 4,730,731.

[51] Int. Cl.[4] ..... B65D 83/04

[52] U.S. Cl. ..... 206/540; 206/811; 206/1.5

[58] Field of Search ..... 206/1.5, 37, 540, 807, 206/811; 220/337

[56] References Cited

U.S. PATENT DOCUMENTS

| | | | |
|---|---|---|---|
| 1,692,041 | 11/1928 | Klein | 206/811 |
| 2,195,593 | 4/1940 | Kreisler . | |
| 2,358,607 | 9/1944 | Tinnerman . | |
| 2,655,259 | 10/1953 | Davoren . | |
| 3,285,464 | 11/1966 | Boydman . | |
| 3,346,099 | 10/1967 | Thomas et al. | 206/811 |
| 3,410,391 | 11/1968 | Kanter | 220/324 |
| 3,749,230 | 7/1973 | Foster . | |
| 3,894,655 | 7/1975 | Matthesis et al. . | |
| 3,913,774 | 10/1975 | Vajtay . | |
| 3,923,180 | 12/1975 | Fields . | |
| 3,954,179 | 4/1976 | Warmath . | |
| 3,968,880 | 7/1976 | Ostrowsky . | |
| 3,972,416 | 8/1976 | Underwood . | |
| 4,007,828 | 2/1977 | Mayled . | |
| 4,093,103 | 6/1978 | Mumford | 206/1.5 |
| 4,102,452 | 7/1978 | Sato et al. . | |
| 4,174,034 | 11/1979 | Hoo . | |
| 4,363,403 | 12/1982 | Raucci et al. . | |
| 4,365,711 | 12/1982 | Long et al. . | |
| 4,511,032 | 4/1985 | Bush . | |
| 4,561,544 | 12/1985 | Reeve . | |
| 4,658,955 | 4/1987 | Eichner | 206/807 |
| 4,730,731 | 3/1988 | Allison | 206/540 |

FOREIGN PATENT DOCUMENTS

| | | | |
|---|---|---|---|
| 1074487 | 1/1960 | Fed. Rep. of Germany | 220/4 B |

*Primary Examiner*—David T. Fidei

*Attorney, Agent, or Firm*—Laubscher, Presta & Laubscher

[57] ABSTRACT

A child-resistant container for pills or the like includes a continuous sealing wall that cooperates with a friction fit with the continuous wall that defines the container chamber, thereby to seal the chamber against moisture. In order to maintain the integrity of the seal during the latching and unlatching operations, the latching arrangement between the top closure and body members is structurally independent of the sealing wall.

4 Claims, 2 Drawing Sheets

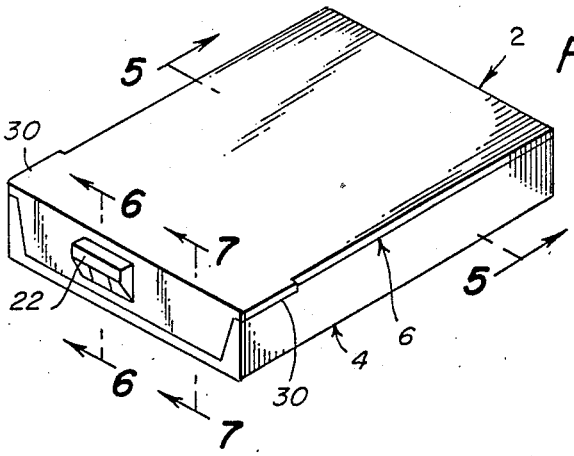
FIG. 1
FIG. 2
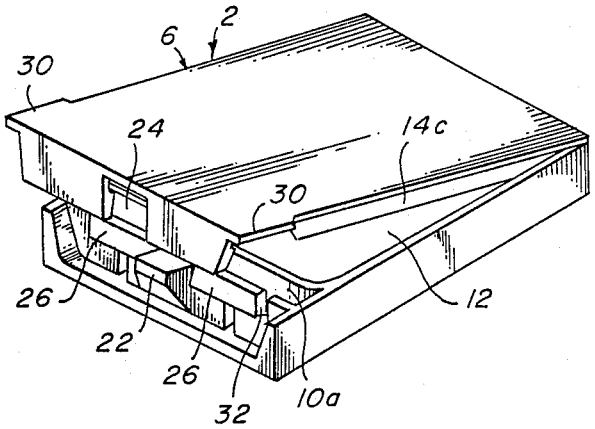
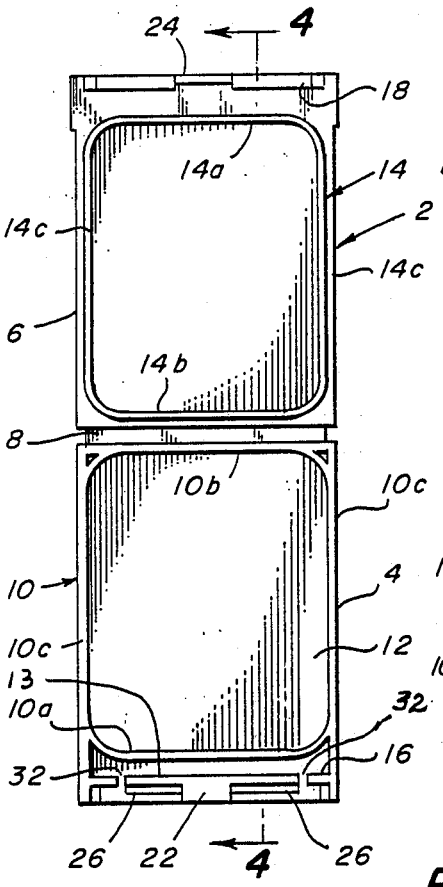
FIG. 3
FIG. 5
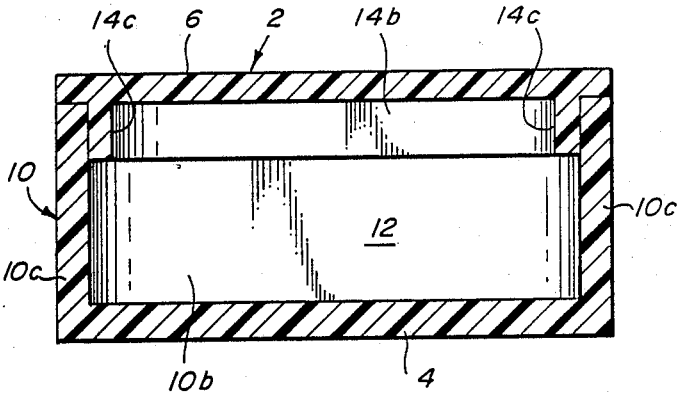
FIG. 4
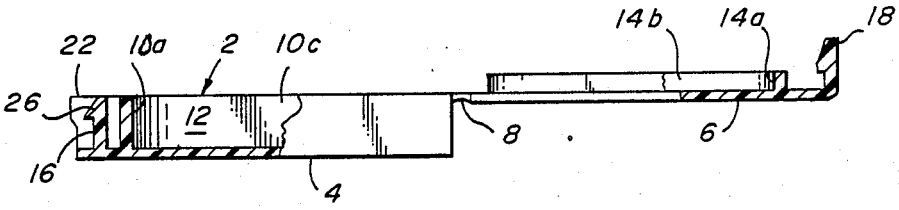

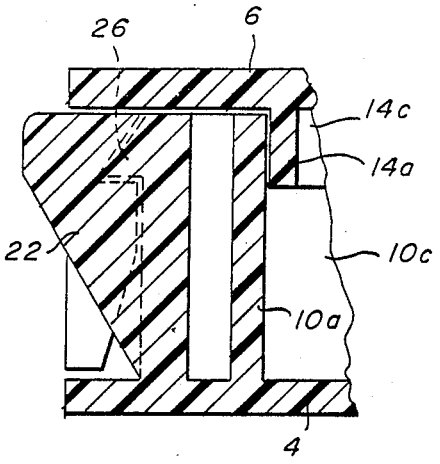
FIG. 6
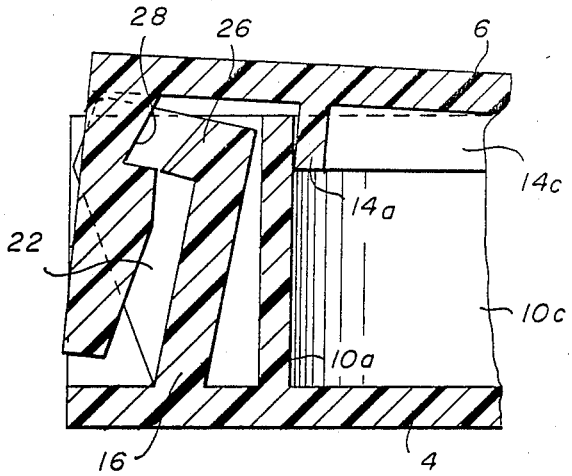
FIG. 8
FIG. 7
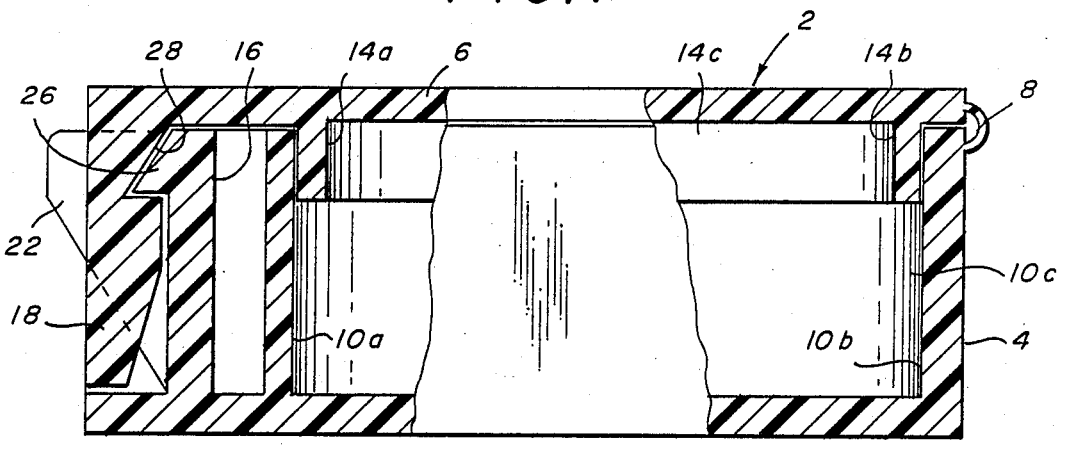

CHILD-RESISTANT MOISTURE-PROOF CONTAINER

REFERENCE TO COMPANION CASE

This application is a continuation-in-part application of the copending prior parent application Ser. No. 926,556 filed Nov. 4, 1986, now U.S. Pat. No. 4,730,731 issued Mar. 15, 1988.

STATEMENT OF THE INVENTION

This invention relates to an improved child-resistant container for pills and the like, including means providing a moisture-proof seal when the container is in a closed, latched condition.

BRIEF DESCRIPTION OF THE PRIOR ART

Child-resistant containers including latch means for locking the top closure member in a closed condition are well known in the patented prior art, as evidenced by the patents to Foster No. 3,749,230, Mattheis et al No. 3,894,655, Ostrowsky No. 3,968,880, Raucci et al No. 4,365,711, and Reeve No. 4,561,544. In the aforementioned parent patent application Ser. No. 926,556, the container is of unitary construction molded from a synthetic plastic material and includes friction means for resisting opening of the cover member when the latch means is in the unlocked condition. The present invention was developed to provide an improved child-resistant of this general type including means for sealing the container chamber against the ingress of moisture when the cover member is in the closed latched condition.

SUMMARY OF THE INVENTION

Accordingly, a primary object of the present invention is to provide a child-resistant container for pills or the like including means for sealing the container chamber against the ingress of moisture when the top closure or cover member is in the closed, latched condition. The container is of unitary construction and is molded from a suitable synthetic plastic material, such as polypropylene.

According to a more specific object of the invention, the body member of the container includes upwardly extending continuous wall means that define the pill-receiving chamber, and the top closure member, which is pivotally connected with the body member by integral hinge means, carries downwardly depending continuous sealing wall means that extend with a friction fit concentrically within the chamber-defining wall means.

Another object of the invention is to provide a child-resistant container of the type described above, wherein the latch means for latching together the top closure and body members is completely independent of the moisture-resistant seal means. To this end, the latch means are provided on first and second latch front wall means on the body and top closure members, respectively, said latch front wall means being spaced from the chamber-defining and sealing wall means. Vertical slots are provided in at least one of the front latch wall means for isolating the latch means from the associated portion of the sealing and chamber-defining wall means, whereby the integrity of the seal means is not adversely affected during the latching and unlatching operation.

BRIEF DESCRIPTION OF THE DRAWINGS

Other objects and advantages of the invention will become apparent from a study of the following specification, when viewed in the light of the accompanying drawings, in which:

FIGS. 1 and 2 are perspective views of the container of the present invention in the closed latched and partially open unlatched conditions, respectively;

FIG. 3 is a top plan view of the container in the fully open condition, and FIG. 4 is a sectional view of the container taken along line 4—4 of FIG. 3;

FIGS. 5–7 are sectional views taken along lines 5—5, 6—6 and 7—7 of FIG. 1, respectively; and FIG. 8 is a detailed view similar to that of FIG. 6, but with the latch button in the inserted latch releasing condition.

DETAILED DESCRIPTION

Referring now more particularly to the drawings, the child-resistant container 2 is preferably of unitary construction molded from a suitable synthetic plastic material, such as polypropylene, or the like. The container includes generally rectangular body and top closure members 4 and 6 that are pivotally connected at one end by integral hinge means 8. The body member includes integral continuous upwardly-extending chamber-defining wall means 10 having a generally-rectangular cross-sectional configuration including front and rear end walls **10*a* and 10*b*, respectively, and a pair of opposed side walls 10*c***.

In accordance with a characterizing feature of the invention, means are provided for sealing the chamber defined by the chamber wall means 10 when the top closure member is in the closed condition of FIG. 1. To this end, the top closure member 6 is provided with downwardly depending continuous sealing wall means 14 having a cross-sectional configuration corresponding with, and adapted for insertion in frictional sealing engagement concentrically within, the chamber-defining wall means 10. These sealing wall means include front and rear walls **14*a* and 14*b*, respectively, and a pair of opposed side walls 14*c***, all of said sealing walls being integral with said top member.

According to another important feature of the invention, latch means are provided for locking together the top and body members when the container is in the closed and sealed condition of FIG. 1. These latch means are provided on first and second latch front walls 16 and 18 arranged at the free ends of the body and top closure members adjacent and spaced from the chamber and sealing front walls **10*a* and 14*a*, respectively. More particularly, as shown in FIG. 7, the second latch front wall 18 extends downwardly from the top closure member 6 parallel with and adjacent the outer surface of the first latch front wall 16 which is integral with, and extends upwardly from, the bottom wall of the body wall member. A central latch releasing button 22 extends forwardly from the first latch front wall 16 through a corresponding opening 24 contained in the second latch front wall. On opposite sides of the latch release button 22 are provided a pair of integral forwardly extending latch projections 26 that are operable to extend within corresponding recesses 28 contained in the adjacent surface of the second latch front wall 18 when the top member is in its closed, sealed condition shown in FIG. 1**. In order to assist in the pivoting of the top closure member toward its fully open position when the latch release button is inserted toward its released position illustrated in FIG. 8, the top closure member 6 is provided adjacent its free end with a pair of laterally extending lifting tabs 30.

At least the first latch front wall 16 is formed of a resilient synthetic plastic material in order to permit the deformation of the first front wall 16 to disengage the latch projections from their associated recesses, as shown in FIG. 8. In accordance with another important feature of the invention, in order to further assist in this resilient deformation without adversely affecting the sealing relationship between the sealing wall means 14 and the chamber-defining wall means 10, the first front wall is provided with a pair of downwardly-extending slots 32 remote from the latch projections 26, as shown in FIG. 3. This affords the advantage that the latching means may be used repeatedly without permanently deforming or damaging either the sealing wall means or the chamber-defining wall means, so that the integrity of the seal is not damaged during repeated use.

OPERATION

In operation, when the child-resistant container is in the closed, latched, sealed and filled condition of FIG. 1, the sealing wall means 14 are in concentric frictional sealing engagement with the inner surface of the chamber-defining wall means 10, thereby to isolate the chamber 12 from ambient atmosphere. To release the latch means, release button 22 is inserted manually by one hand of the user to progressively resiliently deform the first front wall 16 toward the latch-released condition of FIG. 8, whereupon the fingers of the user's other hand are caused to straddle and to lift up on the lateral lifting tabs, and the top closure member 6 is pivoted upwardly (as shown in FIG. 2) to overcome the resisting frictional force between the sealing wall means and the chamber-defining wall means. The top member continues to be pivoted to the fully open condition of FIG. 3, thereby to permit the removal of a pill from the chamber 12.

Upon closing of the container to its initial FIG. 1 condition, the latch means is automatically relatched by the temporary deformation of the resilient first front wall 16 by the cooperation between the latch projections 26 and the second latch wall 18, and the chamber 12 is resealed owing to the frictional cooperation between the wall means 14 and 10.

what is claimed is:

1. A child-resistant moisture-proof container for pills and the like, comprising:

(a) a body member having a bottom wall, and chamber wall means extending upwardly from said bottom wall to define an open-topped chamber;

(b) a top closure member pivotally connected at one end with one end of said body member by integral hinge means for pivotal movement between open and closed positions relative to said body member, said top closure member in said closed position extending across the upper end of said chamber wall means, thereby to close said chamber, said body and top closure members being formed from a synthetic plastic material;

(c) means carried by said top closure member for hermetically sealing said chamber when said top closure member is in said closed position, including sealing wall means extending downwardly from said top closure member and having a cross-sectional configuration corresponding with that of chamber wall means, said sealing and chamber wall means being in concentric frictional moisture-proof engagement when said top closure member is in said closed position;

(d) and latch means for releasably locking together said top closure and body members when said top closure member is in said closed position, said latch means including:

(1) a generally-planar first front wall extending upwardly from said body member bottom wall at the end thereof remote from said one end, said first front wall being parallel with the axis of said integral hinge means and spaced from said chamber wall means;

(2) a second front wall extending downwardly from said top closure member parallel with said first front wall and adjacent the side thereof that is remote from said first front wall, at least said first front wall being deformable;

(3) at least one latch projection extending horizontally from one of said front walls into a corresponding recess contained in the other of said front walls when said top closure member is in the closed position; and (4) means for deforming at least one of said front walls to separate said front walls and to release said latch projection from said recess, thereby to unlock said top closure member, said deforming means including an operating button mounted on said first front wall and extending horizontally forwardly through and slightly beyond a corresponding opening contained in said second front wall.

2. A container as defined in claim 1, wherein said chamber wall means and said sealing wall means have corresponding rectangular cross-sectional configurations, the wall of said chamber and sealing wall means being parallel with or normal to the axis of said integral hinge means, respectively.

3. A container as defined in claim 1, wherein said first front wall contains a pair of vertical downwardly extending slots arranged on opposite sides of the associated latch means, thereby to permit deformation of said first front wall without deformation of said sealing and chamber wall means.

4. A child-resistant moisture-proof container for pills and the like, comprising:

(a) a body member having a bottom wall, and continuous chamber wall means extending upwardly from said bottom wall to define an open-topped chamber;

(b) a top closure member pivotally connected at one end with one end of said body member by integral hinge means for pivotal movement between open and closed positions relative to said body member, said top closure member in said closed position extending across the upper end of said chamber wall means, thereby to close said chamber, said body and top closure members being formed from a synthetic plastic material;

(c) means carried by said top closure member for hermetically sealing said chamber when said top closure member is in said closed position, including continuous sealing wall means extending downwardly from said top closure member and having a cross-sectional configuration corresponding with that of chamber wall means, said sealing and chamber wall means being in concentric frictional moisture-proof engagement when said top closure member is in said closed position;

(d) latch means for releasably locking together said top closure and body members when said top closure member is in said closed position, said latch means including:

(1) a generally-planar first front wall extending upwardly from said body member bottom wall at the end thereof remote from said one end, said first front wall being parallel with the axis of said integral hinge means and spaced from said chamber wall means;

(2) a second front wall extending downwardly from said top closure member parallel with and adjacent the side of said first front wall that is remote from said hinge means, at least said first front wall being deformable;

(3) at least one latch projection extending horizontally from one of said front walls into a corresponding recess contained in the other of said front walls when said top closure member is in the closed position;

(4) means for deforming said first front wall to release said latch projection from said recess, thereby to unlock said top closure member, said deforming means including an operating button mounted on said first front wall and extending horizontally forwardly through and slightly beyond a corresponding opening contained in said second front wall; and (e) lifting tab means extending laterally front said top closure member adjacent said second front wall, whereby upon the operation of said button by one hand of the user, the top closure member may be pivoted toward the open condition by the engagement of said lifting tab means by the fingers of the user's other hand.

* * * * *